US009783866B2

(12) United States Patent
Fukada

(10) Patent No.: US 9,783,866 B2
(45) Date of Patent: Oct. 10, 2017

(54) METHOD FOR PRODUCING STEEL FOR BLADES

(71) Applicant: HITACHI METALS, LTD., Tokyo (JP)

(72) Inventor: Shinichiro Fukada, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 230 days.

(21) Appl. No.: 14/780,204

(22) PCT Filed: Mar. 28, 2014

(86) PCT No.: PCT/JP2014/059120
§ 371 (c)(1),
(2) Date: Sep. 25, 2015

(87) PCT Pub. No.: WO2014/162997
PCT Pub. Date: Oct. 9, 2014

(65) Prior Publication Data

US 2016/0032418 A1 Feb. 4, 2016

(30) Foreign Application Priority Data

Apr. 1, 2013 (JP) ..... 2013-075840

(51) Int. Cl.

| | |
|---|---|
| ***C21D 9/52*** | (2006.01) |
| ***C21D 9/18*** | (2006.01) |
| ***C21D 9/46*** | (2006.01) |
| ***C22C 38/44*** | (2006.01) |
| ***C22C 38/02*** | (2006.01) |
| ***C22C 38/04*** | (2006.01) |
| ***C22C 38/18*** | (2006.01) |
| ***C21D 6/00*** | (2006.01) |
| ***C21D 8/04*** | (2006.01) |
| ***C21D 1/26*** | (2006.01) |
| ***C21D 8/02*** | (2006.01) |
| ***C22C 38/00*** | (2006.01) |
| ***C22C 38/06*** | (2006.01) |
| ***C22C 38/50*** | (2006.01) |

(52) U.S. Cl.

CPC ..... *C21D 9/18* (2013.01); *C21D 1/26* (2013.01); *C21D 6/002* (2013.01); *C21D 6/004* (2013.01); *C21D 6/005* (2013.01); *C21D 6/008* (2013.01); *C21D 8/0236* (2013.01); *C21D 8/0268* (2013.01); *C21D 8/0436* (2013.01); *C21D 8/0473* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/44* (2013.01); *C22C 38/50* (2013.01); *C21D 2211/004* (2013.01); *C21D 2211/005* (2013.01)

(58) Field of Classification Search

CPC ... C21D 9/18; C21D 9/20; C21D 1/26; C21D 6/004; C21D 8/0236

See application file for complete search history.

(56) References Cited

U.S. PATENT DOCUMENTS

| | | | |
|---|---|---|---|
| 4,021,272 | A | 5/1977 | Asai et al. |
| 5,305,526 | A | 4/1994 | Althaus |
| 6,273,973 | B1 | 8/2001 | Parayil et al. |
| 2012/0237390 | A1 | 9/2012 | Jeong et al. |
| 2012/0321501 | A1 | 12/2012 | Chae et al. |

FOREIGN PATENT DOCUMENTS

| | | | |
|---|---|---|---|
| EP | 0485641 | A1 | 5/1992 |
| GB | 2258469 | A | 2/1993 |
| JP | 54-121218 | A | 9/1979 |
| JP | 05-039547 | | 2/1993 |
| JP | H05-277264 | A | 10/1993 |
| JP | 06-145907 | | 5/1994 |
| JP | 2002212679 | A | 7/2002 |
| JP | 3354163 | B2 | 12/2002 |
| JP | 2003515672 | A | 5/2003 |
| JP | 2007224405 | A | 9/2007 |
| JP | 2009-270196 | | 11/2009 |
| KR | 20130019655 | A | 2/2013 |

OTHER PUBLICATIONS

Extended European Search Report corresponding to European Application No. 14778051.4 dated Oct. 21, 2016.
International Search Report corresponding to Japanese Application No. PCT/JP2014/059119 dated Jun. 24, 2014.
International Search Report corresponding to Japanese Application No. PCT/JP2014/059120 dated Jun. 24, 2014.

*Primary Examiner* — Jessee Roe
(74) *Attorney, Agent, or Firm* — Myers Bigel, P.A.

(57) ABSTRACT

Disclosed is a method for producing steel for blades having a metal composition consisting of, by mass, 0.55% to 0.8% C, not more than 1.0% Si, not more than 1.0% Mn, 12.0% to 14.0% Cr, not more than 1.0% Mo, not more than 1.0% Ni, and the balance Fe with impurities, comprising: a batch annealing step for batch annealing a material to be cold rolled having the metal composition at a temperature of 500° C. to 700° C. for 3 to 30 hours; a continuous annealing step for continuously annealing the batch annealed material for 5 to 30 minutes so that the batch annealed material is heated to at least an Ac1 transformation point of the metal composition step to obtain a continuously annealed material; and a cold rolling step for cold rolling the continuously annealed material, wherein the continuous annealing step and the cold rolling step are performed at least once, respectively.

3 Claims, 2 Drawing Sheets

METHOD FOR PRODUCING STEEL FOR BLADES

RELATED APPLICATIONS

This application is a 35 U.S.C. §371 national phase application of PCT Application PCT/JP2014/059120 filed Mar. 28, 2014 which claims priority to Japanese Application No. 2013-075840 filed Apr. 1, 2013. The entire contents of each are incorporated herein by reference in its entirety.

TECHNICAL FIELD

The present invention relates to a method for producing steel for blades that may be used for razors and the like.

BACKGROUND ART

Currently, martensitic stainless steel containing 12.0% to 14.0% by mass of Cr has been generally and widely used as steel for blades, which is used as razors and the like. The martensitic stainless steel is hardened to 620 HV to 650 HV, which is a range of hardness for razor blades, by heat treatments including quenching and tempering. The martensitic stainless steel is superior to high carbon steel in terms of rust prevention and corrosion resistance.

The martensitic stainless steel for razors is usually produced by a combination of hot rolling, cold rolling, and annealing, to be supplied to a subsequent process as razor steel in the form of a strip. In the subsequent process, after being subjected to die cutting, the martensitic stainless steel undergoes heat treatments including quenching and tempering by a continuous furnace and then undergoes blade edging and surface finishing to be produced as a final product.

The metal composition after the martensitic stainless steel is annealed is in a state in which carbides are dispersed in the ferrite structure. The granularity and the state of distribution of the carbides greatly influence the properties of the martensitic stainless steel as a razor blade having undergone heat treatment.

A large number of proposals have been made for stainless steel for razors. Among others, JP 3354163 B (Patent Document 1) by the applicant of the present invention may be mentioned as an invention that significantly improves quenchability by increasing the number of carbides. This Patent Document 1 discloses stainless steel for razors with excellent short-time quenchability consisting of, by mass, 0.55% to 0.73% C, not more than 1% Si, not more than 1% Mn, 12% to 14% Cr, and the balance of Fe with impurities and having a carbide concentration of 140 to 600 carbides/100 $\mu m^2$ in a state of annealing by a continuous furnace. Note that the concentration of carbides shown in Patent Document 1 was obtained by measuring in a strip of stainless steel for razors prior to or during cold rolling in a state in which the steel is inserted into a continuous furnace set to a temperature of or higher than the Ac1 transformation temperature of the steel to be annealed.

JP 06-145907 A (Patent Document 2), which has been proposed by the applicant of the present application, discloses an invention of stainless steel for razors with an excellent quenchability consisting of, by mass, 0.55% to 0.73% C, not more than 1.0% Si, not more than 1.0% Mn, 12% to 14% Cr, 0.2% to 1.0% Mo, not more than 1.0% Ni, and the balance of Fe with impurities and having a carbide concentration of 140 to 200 carbides/100 $\mu m^2$ in an annealed state thereof.

CITATION LIST

Patent Document

[Patent Document 1] JP 3354163 B
[Patent Document 2] JP 06-145907 A

SUMMARY OF INVENTION

Technical Problem

The stainless steel for razors disclosed in Patent Document 1 has implemented excellent quenchability by carrying out continuous annealing at a specific temperature range as an essential step to significantly increase the carbide concentration.

Patent Document 2 intends to improve the carbide concentration by using a batch annealing furnace, but the number of carbides in the resulting steel is at most 200 in an area of 100 $\mu m^2$.

Meanwhile, in recent years, in order to improve productivity, there is a trend that the length of the coil has become longer, and the weight per unit of the coil has increased. Accordingly, it has become more advantageous in terms of the productivity to anneal a plurality of elongated coils by batch processing in a batch annealing furnace than to apply continuous annealing to the coil. A method that can be applied to continuous annealing as a method for increasing the carbide concentration is disclosed in the above-described patent document. However, no method that can be applied to a batch type annealing method has been proposed yet, and accordingly, a production method for steel for blades that can be applied to elongated coils and capable of improving the productivity and achieving a high carbide concentration has been desired.

An object of the present invention is to provide a method for producing steel for blades capable of achieving a high concentration of carbides even with the use of a batch annealing furnace.

Solution to Problem

The inventor of the present invention has examined a method of increasing the concentration of carbides by using a batch annealing furnace in which an alloy having a specific chemical composition is used as a cold rolling material. As a result, the inventor has found that steel for blades with a carbide concentration equivalent to that in Patent Document 1 or higher can be obtained by combining a batch annealing step, a continuous annealing step, and a cold rolling step, i.e., firstly performing the batch annealing step at a specific temperature, performing the continuous annealing step under a temperature of higher than an Ac1 transformation point of the alloy composition, and then performing the cold rolling, and thereby completed the present invention.

According to an aspect of the present invention, there is provided a method for producing steel for blades having a metal composition consisting of, by mass, 0.55% to 0.8% C, not more than 1.0% Si, not more than 1.0% Mn, 12.0% to 14.0% Cr, not more than 1.0% Mo, not more than 1.0% Ni, and the balance Fe with inevitable impurities, the method comprising: a batch annealing step for batch annealing a material to be cold rolled having the metal composition under a temperature having a range of 500° C. to 700° C. for 3 to 30 hours to obtain a batch annealed material; a continuous annealing step for continuously annealing the batch annealed material over 5 to 30 minutes so that the batch annealed material is heated to at least an Ac1 transformation point of the metal composition after the batch annealing step to obtain a continuously annealed material; and a cold rolling step for cold rolling the continuously annealed material after the continuous annealing step, wherein the continuous annealing step and the cold rolling step are performed at least once, respectively.

Advantageous Effects of Invention

According to the production method of the present invention, steel for blades in which the number of carbides in the ferrite structure is 200 to 1,000 in an area of 100 $\mu m^2$ can be easily obtained. By performing batch annealing and continuous annealing in combination, the productivity of steel for blades can be increased.

DESCRIPTION OF EMBODIMENTS

Figure 1:
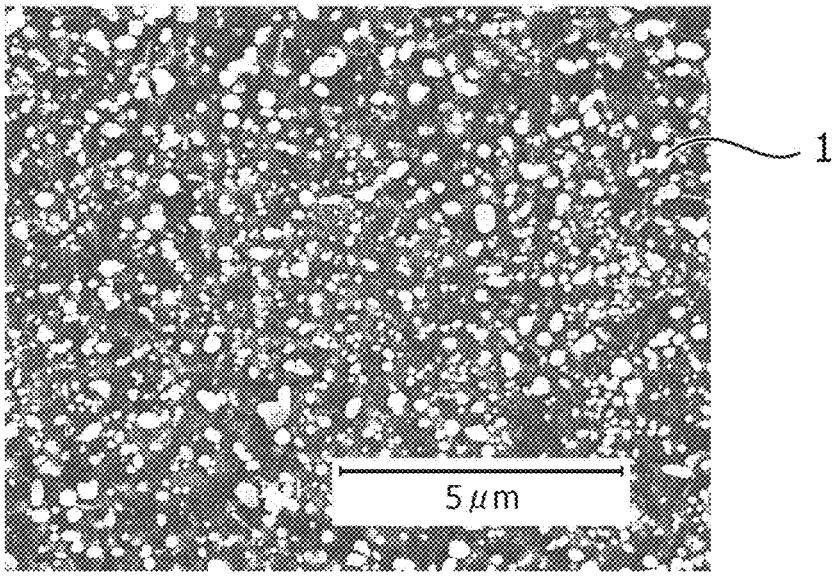
FIG. 1 is an electron microscope photograph showing a cross sectional view of a state of carbides in the steel for blades of Example 1.

The reason a metal composition of steel for blades to be produced by a method for producing steel for blades according to the present invention is limited will be described.

To begin with, the content of carbon (C) is 0.55% to 0.80% by mass. C is an element important not only for yielding the carbide concentration necessary for the present invention but also for determining the hardness of martensite prepared by quenching by dissolving in a matrix from carbides at a quenching austenitizing temperature. It is necessary that the content of C be more than 0.55% by mass in order to obtain the hardness sufficiently high for steel for blades and to obtain the concentration of carbides in the ferrite structure of 200 carbides to 1,000 carbides in an area of 100/$\mu m^2$. Furthermore, in martensite stainless steel, large eutectic carbides crystallize during solidification according to the balance between the content of C and Cr. If such large carbides are included in steel for blades, such as a razor substitute edge material, in particular, with a thickness of about 0.1 mm and a sharp blade, blade chipping may occur. To prevent this, the upper limit of the content of C is 0.80% by mass considering the balance with the content of Cr. The lower limit of the content of C is preferably 0.6% by mass, and more preferably 0.63% by mass. The upper limit of the content of C is preferably 0.78% by mass, and more preferably 0.75% by mass. These limits are determined to more securely obtain the effect of C.

The content of silicon (Si) is not more than 1.0% by mass. Si is an element used as a deoxidant in refining of steel for blades and also for preventing dehardening during low-temperature tempering as a solid solution in steel. If an excessive amount of Si is added, Si may remain in the steel for blades as hard inclusions such as $SiO_2$ and may cause chipping of blades and spot rust, and to prevent this, the upper limit of the content of Si is 1.0% by mass. In order to reliably obtain the effect of Si for resisting dehardening that may occur during low-temperature tempering and to prevent generation of hard inclusions, the content of Si is preferably 0.1% by mass to 0.7% by mass. Furthermore, the lower limit of the content of Si is preferably 0.15% by mass, and more preferably 0.5% by mass. These limits of Si are determined to more reliably yield the effects of Si.

The content of manganese (Mn) is not more than 1.0% by mass. Similarly to Si, Mn can be used as a deoxidant in refining of steel for blades. If the content of Mn exceeds 1.0% by mass, the hot workability may be degraded, and to prevent this, the content of Mn is 1.0% by mass or less. Note that if Mn is used as a deoxidant, not a small amount of Mn remains in the cutting steel. Accordingly, the lower limit of Mn is in a range higher than 0% by mass. A preferable range of the content of Mn is 0.1% by mass to 0.9% by mass. These limits are determined to more reliably yield the effects of Mn.

The content of chrome (Cr) is 12.0% to 14.0% by mass. Cr is an element used for maintaining excellent resistance to corrosion of steel for blades, and forms a carbide with C. Cr is an element important for obtaining Cr carbide that is necessary for controlling the concentration of carbides in a ferrite structure to be 200 carbides to 1,000 carbides in an area of 100/$\mu m^2$. In order to obtain the above-described effect of Cr, at least 12.0% by mass of Cr is necessary. On the other hand, if the content of Cr exceeds 14.0% by mass, the amount of crystallized eutectic carbides may increase, which may cause blades to chip when the steel for blades is used for razors, for example. To prevent this, the content of Cr is in a range of 12.0% by mass to 14.0% by mass. In order to more reliably obtain the above-described effect of adding Cr, the lower limit of Cr is 12.5% by mass, and the upper limit of Cr is preferably 13.5% by mass. These limits are determined to more securely yield the effects of Cr.

The content of molybdenum (Mo) is not more than 1.0% by mass. Mo is an element that enables improvement of the carbide concentration by adding a small amount thereof. If the following production method of the present invention is applied, the carbide concentration can be improved without adding Mo. Accordingly, it is not always necessary to add Mo, i.e., no (0% of) Mo may added. However, Mo has an effect of improving the resistance to corrosion caused by halogen elements such as nonoxidative acids and chlorine that induces pitting. In addition, Mo has a great effect of lowering the quenching critical cooling rate. Consequently, the quenching hardening performance and the quenching depth can be improved, and the temper softening resistance can also be increased. However, if Mo is excessively added, the martensite transformation point may be reduced, an excessive amount of residual austenite may be generated during quenching, and as a result, the quenching hardness may degrade. To prevent this, the upper limit of Mo is 1.0%.

The content of nickel (Ni) is not more than 1.0% by mass. Ni is an element having an effect of increasing the resistance to corrosion. In the present invention, an excellent resistance to corrosion can be imparted by adding Cr. Accordingly, it is not always necessary to add Ni for resistance to corrosion, i.e., no (0% of) Ni may added. However, because Ni has an effect of increasing the toughness, Ni can be added up to 1.0% if it is intended to ensure the toughness of the edge of the steel for blades.

The steel for blades according to the present embodiment is constituted by the elements described above, and the balance is of Fe and inevitable impurities. The inevitable impurities typically include elements such as P, S, Cu, Al, Ti, N, and O, and the content of these elements are in the following range, respectively. If the contents of these elements are in the following ranges, the effects of the elements described above are not inhibited.

P≤0.03% by mass, S≤0.005% by mass, Cu≤0.5% by mass, Al≤0.1% by mass, Ti≤0.1% by mass, N≤0.05% by mass, and O≤0.05% by mass.

Next, a method according to the present invention for achieving the above-described carbides will be described. For a material therefor, a hot rolled material having a metal composition consisting of, by mass, 0.55% to 0.8% C, not more than 1.0% Si, not more than 1.0% Mn, 12.0% to 14.0% Cr, not more than 1.0% Mo, not more than 1.0% Ni, and the balance of Fe with inevitable impurities is used as a material to be cold rolled. The material to be cold rolled is subjected to batch annealing in a temperature range of 500° C. to 700° C. for 3 to 30 hours to obtain a batch annealed material (batch annealing step). After the batch annealing step, the batch-annealed material having been heated to the Ac1 transformation point of the metal composition or higher is subjected to continuous annealing for 5 to 30 minutes to obtain a continuously annealed material (continuous annealing step). After the continuous annealing step, the continuously annealed material is cold-rolled (cold rolling step). The continuous annealing step and the cold rolling step are performed once or more, respectively. Note that the Ac1 transformation point of the steel for blades having the metal composition is about 800° C. The steps of the method will be described below.

In the batch annealing step, the material to be cold rolled is batch annealed at a temperature of 500° C. to 700° C. for 3 to 30 hours to obtain a batch annealed material. The batch annealing is carried out as the first step of the method because in batch annealing, the rate of temperature increase and the rate of temperature decrease can be easily controlled, and also the retention time at a desired temperature can be shortened or elongated. The batch annealing is performed to easily adjust the carbide concentration at the beginning of the process by using the above-described characteristics of batch annealing. By applying batch annealing, the number of long coils of material to be cold rolled that can be processed by batch processing can be increased, and thereby the productivity can be improved. It is advantageous for eight or more coil-like cold rolling materials to be processed by batch annealing performed by batch processing in order to improve productivity, although the effect thereof may vary according to the length of the respective coil-like cold rolling materials. Preferably, ten or more coils may be processed by the batch annealing. This is the reason why the batch annealing that can anneal eight or more coils of cold rolling materials is the first annealing applied to the cold rolling material.

The annealing temperature for the batch annealing is in the temperature range of 500° C. to 700° C. in order to precipitate fine carbides around the grain boundary. If the annealing temperature is 500° C. or less, the amount of the carbides to be precipitated may become insufficient, and it thus becomes difficult to increase the carbide concentration even by adjusting as much as possible the conditions for the subsequent continuous annealing or to uniformly dispersing the carbides. Furthermore, the productivity cannot be improved because the annealing time for the subsequent continuous annealing cannot be shortened. In contrast, if the annealing temperature is 700° C. or higher, carbides may be precipitated in crystal grains, and thus, the carbides may excessively grow during the subsequent continuous annealing, and as a result, the highly concentrated form of carbides cannot be obtained. To prevent this, in the present invention, the temperature for the batch annealing is a temperature in the range of 500° C. to 700° C. A preferable lower limit of the batch annealing temperature is 520° C., and more preferably 530° C. A preferable upper limit of the batch annealing is 650° C., and more preferably 620° C.

The annealing time for the batch annealing is 3 hours to 30 hours. If the time for the batch annealing is less than 3 hours, the effect of precipitating the carbides in the grain boundary may be insufficient. Because no great difference may be obtained in the form of precipitation of the carbides in the grain boundary if the time for the batch annealing is more than 30 hours, the upper limit of the annealing time for the batch annealing is 30 hours. The preferable lower limit of the batch annealing time is 5 hours, and more preferably 10 hours. The preferable upper limit of the batch annealing time is 24 hours, and more preferably 20 hours. In order to increase the carbide concentration by the above-described batch annealing and the continuous annealing at the transformation point Ac1 or higher as much as possible, the annealing time for the batch annealing may be a relatively short time ranging from 10 to 15 hours. The temperature range and the annealing time for the batch annealing provided in the present invention may be applied to annealing by one stage or may be annealing by multiple stage heating patterns, for example.

The continuous annealing step is a step of obtaining a continuously annealed material by heating the batch-annealed material obtained after the batch annealing step at the transformation point Ac1 of the metal material or higher and performing continuous annealing for 5 to 30 minutes. By performing the continuous annealing in which the batch-annealed material is heated to the transformation point Ac1 or higher, fine and highly concentrated carbides can be obtained in the crystal grains. In this step, in order to control the number of the carbides in the ferrite structure to be 200 to 1,000 carbides in an area of 100 $\mu m^2$, it is preferable to perform the continuous annealing in a temperature range higher than the transformation point Ac1 by 0 to 100° C.

If the time for the continuous annealing in which the batch-annealed material is heated to the transformation point Ac1 or higher is less than 5 minutes in the continuous annealing step, the carbide concentration may not improve, and thus, it becomes difficult to obtain steel for blades having the carbide concentration of 200 to 1,000 carbides in an area of 100 $\mu m^2$. To prevent this, the lower limit of the continuous annealing time is 5 minutes. In contrast, if the time for annealing at the transformation point Ac1 or higher is more than 30 minutes, the productivity may degrade due to saturation of the effect of dispersion of fine carbides, and to prevent this, the upper limit of the annealing time is 30 minutes.

The cold rolling step is a step of rolling the continuously annealed material at room temperature without heating the continuously annealed material. The cold rolling can be performed by a reverse cold rolling machine. The thickness of the cold rolling material is adjusted to a desired thickness in the cold rolling. If the hardness of the cold rolling material is excessively high during the cold rolling, because the reduction rate would not increase if the number of times of passage of the cold rolled material during the cold rolling step is increased, the reduction rate is determined in consideration of the increase of the hardness of the cold rolled material and the following continuous annealing is performed in combination therewith.

If the carbides can be precipitated in the grain boundary in the batch annealing step and a sufficient number of carbides can be further precipitated in the crystal grains in the continuous annealing step in which the material is heated to the transformation point Ac1 or higher, then after that, the continuous annealing step of heating the material to the transformation point Ac1 or higher can be omitted. Note that as the steel for blades production method, in addition to the steps described above, an annealing step of annealing at a temperature lower than the transformation point Ac1 of the steel for blades and the like can be included. This annealing step is a step having an effect of eliminating the strain generated due to processing on the cold rolling material and an effect of softening the cold rolling material that has been processed and hardened. If this annealing step is also a continuous annealing step, the productivity would not be hindered. In addition to the steps described above, other steps such as a trimming step for cutting the edges of the cold rolling material can be included.

By applying the production method of the present invention described above, steel for blades in which 100 to 1,000 carbides exist in an area of 100 $\mu m^2$ of the ferrite structure can be produced. The above-described metal composition provided in the present invention is a metal composition obtained after performing the last annealing and the cold rolling. The steel for blades according to the present invention is martensitic stainless steel; however, in an annealed state, the martensitic stainless steel is in a form in which carbides are dispersed in the ferrite structure. In the ferrite structure, several percent of remaining austenite may be observed in some rare cases, and therefore a steel product in which less than 3% of austenite has been observed to exist is also included in the steel for blades according to the present invention.

In the present invention, the carbide concentration is determined by a method in which an area of 100 $\mu m^2$ of the metal composition is observed and determined by using an electron microscope. The area to be observed is preferably 100 $\mu m^2$. This is because it is sufficient to measure the concentration of carbides in an area of 100 $\mu m^2$ because if the concentration of carbides is measured in an area exceeding 100 $\mu m^2$, the measurement result would not be greatly different. The carbides are observed and measured by using the electron microscope because if 200 to 1,000 carbides are present in an area of 100 $\mu m^2$ as in the present invention, i.e., if the carbide concentration is 2 carbides/$\mu m^2$ to 10/$\mu m^2$, precise observation and analysis cannot be performed without using an electron microscope due to fine size of the carbides. Specifically, for the observation and the measurement of the carbides, an image observed by using the electron microscope is subjected to image analysis and the measurement is performed by calculating the number of carbides according to the result of the image analysis. In this measurement, if the accelerating voltage of the electron microscope becomes excessively high, the carbides existing on the matrix may possibly be detected. In contrast, if the accelerating voltage of the electron microscope becomes excessively low, the resolution may degrade, and accordingly, the accelerating voltage may be set at 15 kv for observation. It is preferable that the number of the carbides in the ferrite structure be in a range of 500 to 800 in the area of 100 $\mu m^2$.

EXAMPLES

The present invention will be more specifically described with reference to Examples and Conventional Examples, but the present invention is not limited to the following Examples in any way.

Example 1

The alloy composition and the thickness of the hot-rolled material were determined with reference to the example described in Patent Document 1. A hot-rolled material with the thickness of 1.7 mm and the length of 500 m was prepared. Table 1 shows the metal composition of the hot-rolled material. Of the metal compositions shown in Table 1, "Conventional Example" is No. C steel having the highest carbide concentration among the steel described in the examples of Patent Document 1. Example 1 of the present invention was intended as steel having the same metal composition as that of No. C steel.

TABLE 1

| C | Si | Mn | Cr | Mo | Ni | Balance | Note |
|---|---|---|---|---|---|---|---|
| 0.69 | 0.28 | 0.75 | 13.25 | 0.07 | 0.01 | Fe and inevitable impurities | Example 1 |
| 0.66 | 0.63 | 0.75 | 13.59 | — | — | Same as above | Conventional Example |

(% by mass)

The hot-rolled material according to Example 1 was used as the cold rolling material, and 12 coils of cold rolling materials were subjected to the batch annealing at 560° C. for 13 hours. Subsequently, the coils of the materials were fed into a continuous furnace having a heating zone and continuous annealing was performed at 850° C. for 10 minutes. The materials were subjected to temporal verification of the metal composition, and it was observed that sufficiently fine and highly concentrated carbides were precipitated in the crystal grain boundary and in the crystal grains. It was determined that a sufficient effect of the annealing process had been obtained, and thus it was determined that it was not necessary to perform continuous annealing of heating the material at the transformation point Ac1 or higher after the subsequent cold rolling step. Note that the Ac1 transformation point for steel for blades shown in Table 1 was 800° C. for both Example 1 and the Conventional Example. In these tests, 12 hot-rolled material coils were inserted in the batch annealing furnace, and if the number of the coils is further increased, the productivity can be further improved.

Next, the oxide layer previously formed on the surface was removed to perform cold rolling. The first cold rolling was performed so that the rolling ratio would be 50% or more. Subsequently, the material further underwent continuous annealing performed at 750° C. for 10 minutes, and the second cold rolling was performed so that the rolling ratio would be 50% or higher. The material was further subjected to continuous annealing performed at 750° C. for 10 minutes, and then the last cold rolling was performed so that the thickness of the product would become 0.1 mm to produce the steel for blades of Example 1. No failures such as cracked material and the like occurred during the cold rolling.

The production method of Conventional Example will be described. A hot-rolled material having the metal composition shown in Table 1 and a thickness of 1.7 mm was fed into a continuous furnace having a heating zone set at 850° C.×20 minutes, annealing was performed therein, and then steps of cold rolling, annealing at 780° C.×5 minutes, cold rolling, annealing at 780° C.×5 minutes, and cold rolling were performed to produce steel for blades with the thickness of 0.1 mm.

Test pieces for observing the concentration of the carbides were sampled from the steel for blades of Example 1 and the steel for blades of the Conventional Example obtained as described above, and the carbide concentration was measured by using an electron microscope. The observation surface was ground by using emery paper into a flat surface and then was subjected to electrolytic polishing and corrosion with Nital solution to expose the carbides. A scanning electron microscope was used for the observation of the carbides of the test pieces. For the measurement condition, the accelerating voltage was 15 kv, and the image observed in the observation area of 100 $\mu m^2$ by using the electron microscope was subjected to image analysis. The number of the carbides and the circle equivalent diameter of the respective carbides were determined according to the results of the image analysis, and the concentration of the carbides, the size of the carbides, and the average size of the carbides were determined.

FIG. 1 shows an electron microscope photograph of the form of the carbide observed by using the steel for blades according to Example 1. The concentration of the carbides according to Example 1 was very high and the size of the respective carbides was fine, and thus the magnification of the electron microscope photograph shown in FIG. 1 is 10,000×. As shown in FIG. 1, it can be seen that fine carbides 1 of 0.6 μm at the maximum were homogeneously dispersed. The composition of the carbides was determined by using an energy dispersive X-ray analyzer, and as a result, the carbides were a Cr carbide.

Figure 4:
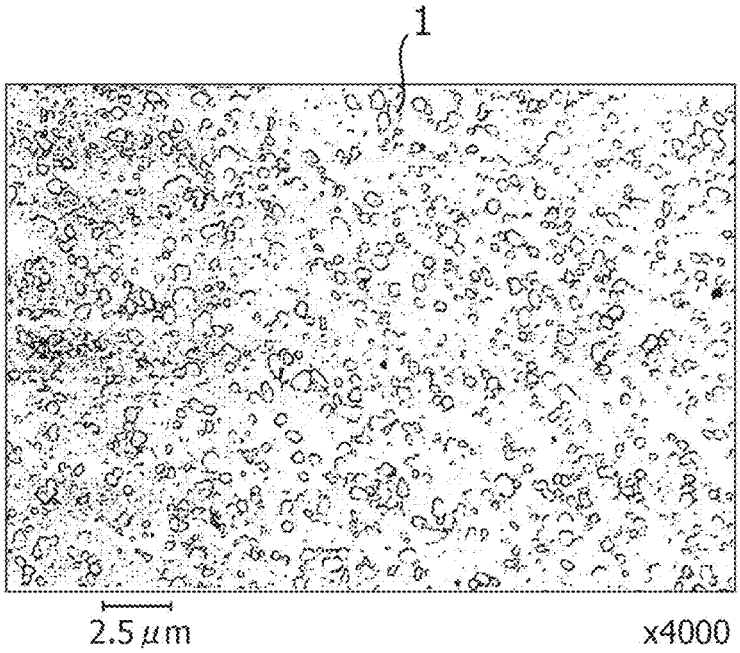
FIG. 4 is an electron microscope photograph showing a cross sectional view of a state of carbides in the steel for blades of a Conventional Example.

FIG. 4 shows an electron microscope photograph of the form of the carbide observed by using the steel for blades according to the Conventional Example. The magnification is 4,000×. In FIG. 4, carbides of a maximum size of 1 μm were observed. It can be seen that the carbide concentration was lower than that shown in FIG. 1.

Table 2 shows the carbide concentration of Example 1 and that of the Conventional Example determined based on the number of the carbides in an area of 100 $\mu m^2$.

TABLE 2

| | Carbide concentration (carbides/100 $\mu m^2$) |
|---|---|
| Example 1 | 731 |
| Conventional Example | 560 |

As shown in Table 2, it can be seen that in the steel for blades of Example 1, carbides were highly concentrated and were as much as 731 carbides/100 $\mu m^2$.

Examples 2 and 3

Next, tests were performed under heat treatment conditions different from those in Example 1. The alloy composition was the same as that in Example 1, and the thickness of the hot-rolled material was 1.7 mm similarly to that in Example 1.

The same hot-rolled material (cold rolling material) as that in Example 1 was used as the starting material, and 12 coils of the hot-rolled materials were subjected to the batch annealing performed at 560° C. for 5 to 10 hours to obtain the batch-annealed material of Example 2. Furthermore, the same hot-rolled material (cold rolling material) as that in Example 1 was used as the starting material, and 12 coils of the hot-rolled materials were subjected to the batch annealing performed at 570° C. for 10 to 15 hours to obtain the batch-annealed material of Example 3. Subsequently, the above-described batch-annealed material was subjected to continuous annealing performed at 850° C. for 10 minutes, then the continuously annealed material was subjected to temporal verification for the metal composition, and as a result, it was observed that sufficiently fine and highly concentrated carbides were participated in the crystal grain boundary and in the crystal grains. Accordingly, it was determined that it was not necessary to perform continuous annealing of heating the material at the transformation point Ac1 or higher after the subsequent cold rolling step. In these tests, 12 hot-rolled material coils were inserted in the batch annealing furnace, and if the number of the coils is further increased, the productivity can be further improved.

Next, the oxide film previously formed on the surface was removed to perform cold rolling. The first cold-heading was performed so that reduction became more than 50%. The first cold rolling was performed so that the rolling ratio would be 50% or higher. Subsequently, the material was further heated to 750° C., continuous annealing was performed at 750° C. for 10 minutes, and the second cold rolling was performed so that the rolling ratio would be 50% or higher. The material was further heated to 750° C., continuous annealing was performed at 750° C. for 10 minutes, and then the last cold rolling was performed so that the thickness of the product would become 0.1 mm to produce the steel for blades of Examples 2 and 3. No failures such as cracked material and the like occurred during the cold rolling.

Test pieces for observing the concentration of the carbides were sampled from the steel for blades of Examples 2 and 3 and the steel for blades of the Conventional Example obtained as described above, and the carbide concentration was measured by using an electron microscope. The observation surface was ground by using emery paper into a flat surface, and then was subjected to electrolytic polishing and corrosion with Nital solution to expose the carbides. A scanning electron microscope was used for the observation of the carbides of the test pieces. For the measurement condition, the accelerating voltage was 15 kv, and the images observed in the observation area of 100 $\mu m^2$ by using the electron microscope were subjected to image analysis. The number of the carbides and the circle equivalent diameter of the respective carbides were determined according to the results of the image analysis, and the concentration of the carbides, the size of the carbides, and the average size of the carbides were determined.

Figure 2:
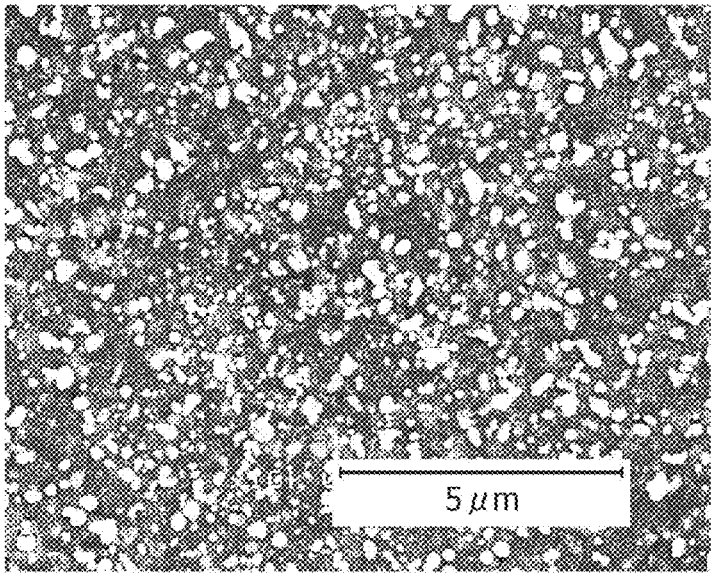
FIG. 2 is an electron microscope photograph showing a cross sectional view of a state of carbides in the steel for blades of Example 2.
Figure 3:
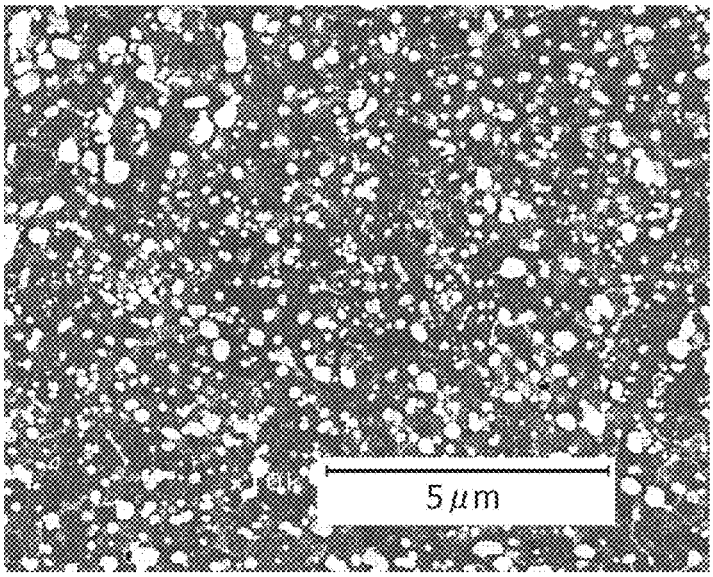
FIG. 3 is an electron microscope photograph showing a cross sectional view of a state of carbides in the steel for blades of Example 3.

FIG. 2 shows an electron microscope photograph of the form of the carbide observed by using the steel for blades according to Example 2. FIG. 3 shows an electron microscope photograph of the form of the carbide observed by using the steel for blades according to Example 3. The concentration of the carbides according to Examples 2 and 3 was very high, and thus the magnification of the electron microscope photograph shown in FIGS. 2 and 3 is 10,000×, respectively. As shown in FIGS. 2 and 3, it is known that fine carbides 1 of 0.6 μm at the maximum were homogeneously dispersed. The composition of the carbides was determined by using an energy dispersive X-ray analyzer, and as a result, the carbides were a Cr carbide. Table 3 shows the concentration of the carbides of Example 2 and Example 3 determined based on the number of carbides in an area of 100 $\mu m^2$.

TABLE 3

| | Carbide concentration (carbides/100 $\mu m^2$) |
|---|---|
| Example 2 | 785 |
| Example 3 | 583 |

As shown in Table 3, in the steel for blades of Example 2, the carbides were highly concentrated and were as much as 785 carbides/100 $\mu m^2$. In the steel for blades of Example 3 also, carbides were highly concentrated to as much as 583 carbides/100 $\mu m^2$ were obtained.

As described above, because more than 550 carbides exist in the area of 100 $\mu m^2$ of the steel for blades according to the present invention, it can be understood that the steel for blades according to the present invention has achieved the carbide concentration necessary for steel for blades having an excellent quenchability.

INDUSTRIAL APPLICABILITY

The steel for blades according to the present invention is optimal for use as steel for razors, and therefore, it is industrially useful. If the steel for blades is used for razors, it is preferable that the thickness of the steel for blades be 0.1 mm or less, similarly to the above-described Examples.

LIST OF REFERENCE SYMBOLS

1: Carbides

The invention claimed is:

1. A method for producing steel for blades having a metal composition consisting of, by mass, 0.55% to 0.8% C, not more than 1.0% Si, not more than 1.0% Mn, 12.0% to 14.0% Cr, not more than 1.0% Mo, not more than 1.0% Ni, and the balance of Fe with inevitable impurities, the method comprising:

a batch annealing step for batch annealing a material to be cold rolled having the metal composition in a temperature having a range of 500° C. to 700° C. for 3 to 30 hours to obtain a batch annealed material;

a continuous annealing step for continuously annealing the batch annealed material for 5 to 30 minutes so that the batch annealed material is heated to at least an Ac1 transformation point of the metal composition after the batch annealing step to obtain a continuously annealed material; and a cold rolling step for cold rolling the continuously annealed material after the continuous annealing step, wherein the continuous annealing step and the cold rolling step are performed at least once, respectively.

2. The method for producing steel for blades according to claim 1, wherein the number of carbides in a ferrite structure of the steel for blades after the cold rolling step is 200 to 1,000 in an area of 100 $\mu m^2$.

3. The method for producing steel for blades according to claim 2, wherein a concentration of the carbides in the ferrite structure of the steel for blades after the cold rolling step is 2 carbides/$\mu m^2$ to 10 carbides/$\mu m^2$.

* * * * *